US008573286B2

(12) United States Patent
Domes et al.

(10) Patent No.: US 8,573,286 B2
(45) Date of Patent: Nov. 5, 2013

(54) HEAT EXCHANGER FOR A MOTOR VEHICLE

(75) Inventors: Christian Domes, Stuttgart (DE); Peter Geskes, Ostfildern (DE)

(73) Assignee: Behr GmbH & Co. KG, Stuttgart (DE)

( * ) Notice: Subject to any disclaimer, the term of this patent is extended or adjusted under 35 U.S.C. 154(b) by 952 days.

(21) Appl. No.: 12/282,213

(22) PCT Filed: Mar. 9, 2007

(86) PCT No.: PCT/EP2007/002084

§ 371 (c)(1),
(2), (4) Date: Sep. 9, 2008

(87) PCT Pub. No.: WO2007/104491

PCT Pub. Date: Sep. 20, 2007

(65) Prior Publication Data

US 2009/0090495 A1 Apr. 9, 2009

(30) Foreign Application Priority Data

Mar. 10, 2006 (DE) ..... 10 2006 011 592

(51) Int. Cl.
*F28F 13/00* (2006.01)
*F28F 1/42* (2006.01)

(52) U.S. Cl.
USPC ..... 165/146; 165/109.1; 165/179

(58) Field of Classification Search
USPC ..... 165/101, 103, 146, 147, 174, 179, 66, 165/109.1
See application file for complete search history.

(56) References Cited

U.S. PATENT DOCUMENTS

| | | | | | |
|---|---|---|---|---|---|
| 1,834,070 | A * | 12/1931 | Parkinson | 165/301 |
| 3,161,234 | A * | 12/1964 | Rannenberg | 165/163 |
| 3,211,217 | A * | 10/1965 | McKee et al. | 165/95 |
| 3,447,602 | A * | 6/1969 | Dalin | 165/145 |
| 5,314,009 | A | 5/1994 | Yates et al. | |
| 6,634,419 | B1 * | 10/2003 | Beldam et al. | 165/146 |
| 6,948,559 | B2 * | 9/2005 | Reinke et al. | 165/140 |
| 7,073,573 | B2 * | 7/2006 | Agee | 165/146 |
| 2002/0014326 | A1 | 2/2002 | Nakado et al. | |
| 2002/0017382 | A1 * | 2/2002 | Nakado et al. | 165/152 |
| 2003/0111211 | A1 * | 6/2003 | Stonehouse et al. | 165/103 |
| 2005/0016716 | A1 * | 1/2005 | Hu et al. | 165/110 |
| 2005/0230088 | A1 * | 10/2005 | Beldam et al. | 165/146 |
| 2005/0274501 | A1 | 12/2005 | Agee | |
| 2006/0048926 | A1 * | 3/2006 | Richter | 165/165 |

FOREIGN PATENT DOCUMENTS

| | | | |
|---|---|---|---|
| DE | 31 03 198 | A1 | 8/1982 |
| DE | 31 40 687 | A1 | 4/1983 |
| EP | 1 355 058 | A2 | 10/2003 |
| ES | 2 234 398 | A1 | 6/2005 |
| JP | 2001-27157 | A | 1/2001 |

* cited by examiner

*Primary Examiner* — Tho V Duong
(74) *Attorney, Agent, or Firm* — Foley & Lardner LLP

(57) ABSTRACT

The invention relates to a heat exchanger for a motor vehicle, comprising a first flow path (1), a deflection region (13) located downstream of the first flow path (1) and a second flow path (2) that is located downstream of the deflection region (13). The first and second flow paths (1, 2) can be traversed by a fluid to be cooled and can be surrounded by a coolant to dissipate heat. The second flow path (2) has a flow resistance that differs from that of the first flow path (1).

14 Claims, 2 Drawing Sheets

HEAT EXCHANGER FOR A MOTOR VEHICLE

The present invention relates to a heat exchanger for a motor vehicle.

The development of, in particular, exhaust gas heat exchangers for motor vehicles involves special requirements. Thus, considerable temperature differences, along with an often very confined construction space, have to be overcome, while the pressure drop across the heat exchanger must be low, and, moreover, further problems, such as possible condensation and the formation of tenacious deposits, are to be borne in mind.

As regards adaptation to the confined construction space, U-flow types of construction of heat exchangers, as they are known, have proved to be advantageous. In this type of construction, the exhaust gas stream is steered through a first flow path, then deflected through usually 180 degrees and returned through a second flow path for further cooling. This makes it possible to have a compact connection region with an adjacent supply line and discharge line on one side and also a compact and, in particular, relatively short type of construction. In direct comparison with heat exchangers having, for example, a straight build, U-flow heat exchangers have mostly a higher flow resistance for a given cooling capacity and a given construction space volume.

The object of the invention is to specify a heat exchanger for a motor vehicle, which heat exchanger is improved in terms of its flow resistance.

For a heat exchanger initially mentioned, this object is achieved, according to the invention, by means of the characterizing features the embodiments described herein. By the flow resistances of the two individual flow paths being designed differently, the overall flow resistance for a given efficiency and for a given overall size is optimized, since the cooling of the fluid which has already taken place in the first flow path is taken into account upon entry into the second flow path. In the preferred version, in this case, the fluid is the exhaust gas from an internal combustion engine of the motor vehicle. During the cooling of exhaust gas, which is carried out, in particular, for exhaust gas recirculation for the purpose of reducing the pollutants of diesel engines, a particularly pronounced temperature difference of typically several hundred ° C. is achieved during fluid cooling, so that the adaptation of the flow resistances of the two flow paths following one another is particularly effective during the cooling of the exhaust gas.

Advantageously, in this case, the first flow path has a lower flow resistance than the second flow path. In the region of the first flow path, on average, a higher temperature difference with respect to the coolant prevails than in the region of the second flow path. This affords a high cooling capacity simply by virtue of the temperature difference. Moreover, in this region, because of the temperature at least of gaseous fluids, there are in any case high pressure losses, and therefore the flow resistance, in this case particularly the generation of turbulences for improving the heat transmission, can be kept relatively low in the first flow path. The fluid, when it enters the second flow path, is already partially cooled, so that a higher flow resistance, in particular a larger fraction of turbulent flows, is advantageously present in the second flow path in order to obtain sufficient heat transmission. Thus, overall, an optimization of the heat exchanger capacity is achieved, taking account of the fact that the overall pressure drop across the heat exchanger should be as low as possible.

In a preferred embodiment, turbulence-generating means are provided in at least one of the two flow paths, with the result that the heat exchanger capacity is improved. Preferably, the turbulence-generating means are designed as shaped-out portions, projecting into the flow path, of walls of the flow path. These may be dimples or what are known as "winglets" (embossed webs oriented in a V-shaped manner). Alternatively or additionally, the turbulence-generating means may also be inserts secured in the flow path. Such inserts may be, for example, web ribs or corrugated ribs or the like. Basically, all turbulence-generating means which are known from the prior art are suitable within the meaning of the present invention. It is essential merely to have the different design of the flow resistances in the first flow path and in the second flow path.

Alternatively or additionally, furthermore, ribs for enlarging a contact surface with the fluid may be arranged in the flow paths, the ribs in the first flow path and in the second flow path having a different density. Also in a situation where there are, for example, longitudinal ribs, such as, for example, corrugated ribs, and in which predominantly laminar and less turbulent flows are formed, a different density of the ribs leads to different flow resistances. The flow resistances of the flow paths can therefore be influenced basically both by the generation of turbulences and by influencing laminar flow fractions.

Alternatively or additionally, furthermore, the first flow path and the second flow path may in each case comprise a plurality of separate parallel flow ducts. Preferably, in this case, the number of ducts of the first flow path is different from, in particular smaller than, the number of ducts of the second flow path. Alternatively or additionally, the ducts of the first flow path may in each case have a different, in particular larger, cross-sectional area from the ducts of the second flow path. In any of the ways mentioned, a suitable adaptation of the flow resistances of the flow paths, taking into account the required operating conditions of the heat exchanger, can take place.

Moreover, for further improvement, there is advantageously provision for the ducts of a flow path to have flow resistances different from one another. Particularly advantageously, the flow resistance of a duct lying externally with respect to the deflection region is higher than the flow resistance of an internally lying duct of the same flow path. A further fine optimization is thereby achieved, since the flow distances, flow velocities and temperatures of the fluid stream generally vary over the cross section of one of the flow paths.

Preferably, in general, the first flow path has a free cross-sectional area which is different from, in particular larger than, that of the second flow path. The free cross-section area means in this context the geometric cross-sectional area for the free throughflow of the fluid.

Advantageously, the flow paths are arranged in a housing through which the coolant flows. Advantageously, furthermore, in this case the coolant is a liquid, in particular the cooling liquid of a main cooling circuit of the motor vehicle. This ensures, overall, an effective cooling of the fluid.

In a particularly preferred embodiment, the heat exchanger comprises a connection region with a first connection for supplying the fluid to the first flow path and with a second connection for discharging the fluid from the second flow path, with the result that a compact and cost-saving type of construction of the heat exchanger is made possible. In a version which is also preferred, in the connection region an actuating element is provided, by means of which a direct link between the first connection and second connection can be set selectively in order to bypass the flow paths. As a result, the cooling of the fluid can be bypassed selectively, this being desirable precisely in internal combustion engines and motor vehicles, under specific operating conditions, such as, for example, the warm-up phase of the engine.

In an advantageous development of the invention, the flow paths and/or the flow ducts are produced from aluminum.

In an advantageous development of the invention, the flow paths and/or the flow ducts are produced from high-grade steel.

In an advantageous development of the invention, the flow paths and/or the flow ducts are produced from aluminum and from high-grade steel.

Further advantages and features of the invention may be gathered from the exemplary embodiments described below and from the dependent claims.

Three preferred exemplary embodiments of a heat exchanger according to the invention are described below and are explained in more detail by means of the accompanying drawings in which.

Figure 1:
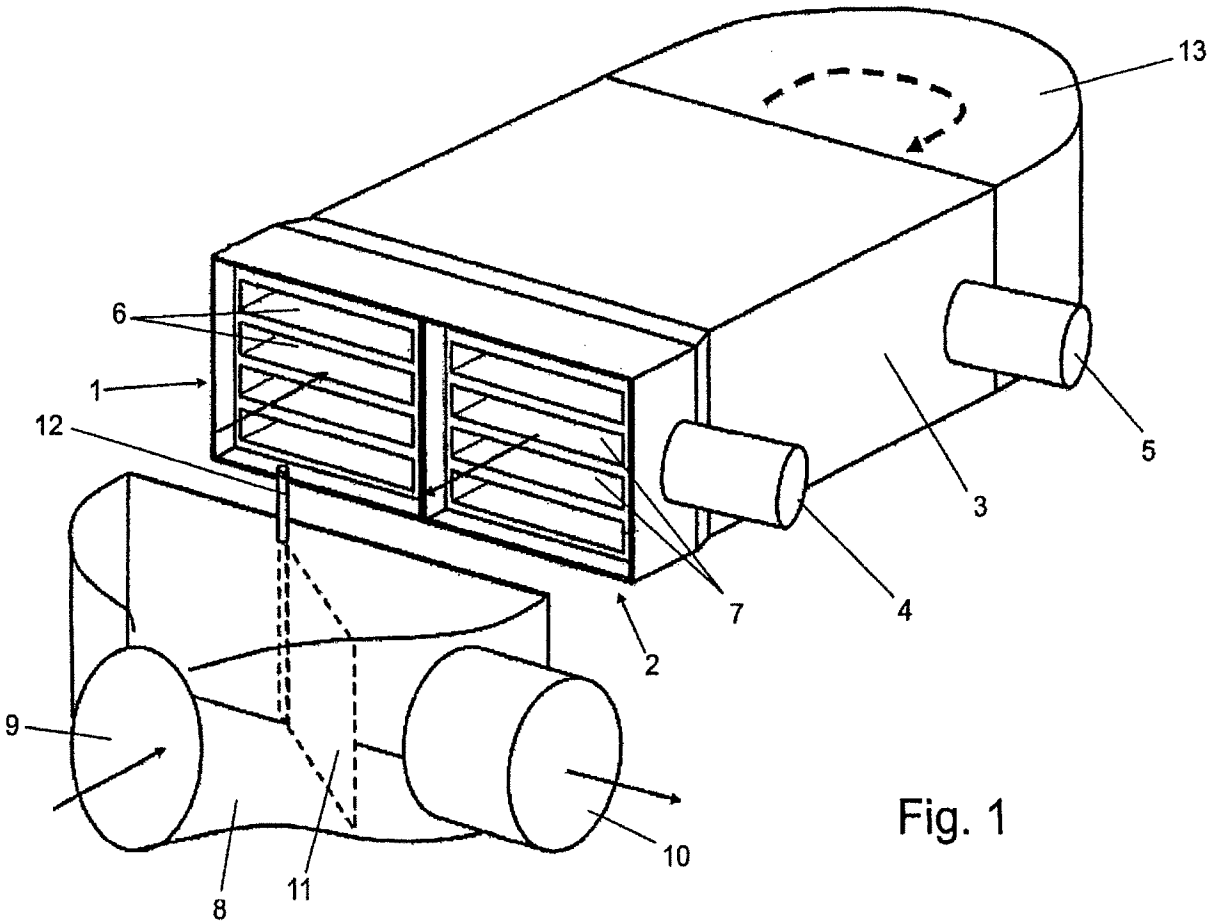
FIG. 1 shows a diagrammatic three-dimensional view of a general U-flow heat exchanger.

FIG. 1 shows a U-flow heat exchanger for the cooling of recirculated exhaust gas from a motor vehicle diesel engine, in which a first flow path 1 and a second flow path 2 are arranged parallel and next to one another inside a housing 3. A liquid coolant flows through the housing 3 by means of two connections 4, 5 and is branched off from a main cooling circuit of a diesel engine. The flow paths 1, 2 comprise in each case a number of flow ducts 6, 7 which in the present instance are designed as flat tubes of rectangular cross section. The cross section may also basically have another, for example round, shape.

The liquid coolant flows around each of the tubes 6, 7 inside the housing 3. On a front side of the housing 3, a connection region 8 is arranged and connected by welding, which is illustrated separately from the housing 3 in FIG. 1 for the sake of clarity. The connection region 8 has a first connection 9 for the supply of exhaust gas from a diesel engine of the motor vehicle and a second connection 10 for discharging the cooled exhaust gas. Inside the connection region 8, an actuating element 11 designed as a pivotable flap is provided, which can be adjusted via a rotary shaft 12. In a first position of the actuating element 11, which is illustrated in FIG. 1, the exhaust gas is conducted from the first connection 9 into the first flow path 1, where it initially experiences a first cooling. After flowing through the first flow path 1, the exhaust gas enters a deflection region 13 arranged on the end face of the housing 3.

The deflection region 13, here, is an essentially semi-cylindrical hollow housing part, in which the exhaust gas stream is deflected through 1800, after which it enters the second flow path 2. The exhaust gas flows through the second flow path 2 in a direction opposite to the first flow path 1, and at the same time it undergoes further cooling. When it leaves the second flow path 2, the exhaust gas again enters the connection region 8 where, in the case of the first position of the actuating element 11 according to FIG. 1, it is led into the second connection 10.

In another position, not illustrated, of the actuating element 11, the exhaust gas is prevented from flowing through the flow paths 1, 2, and in this case it is conducted directly from the first connection 9 into the second connection 10. In this case, it does not experience any appreciable cooling, and therefore this type of operation is assigned mainly to specific operating conditions, such as, for example, a warm-up phase of the internal combustion engine ("bypass operation").

Figure 2:
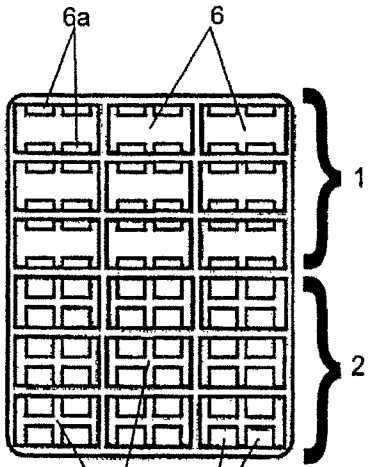
FIG. 2 shows a diagrammatic cross section through a first exemplary embodiment of a heat exchanger according to the invention.

In the case of the first position of the actuating element 8, the exhaust gas has a markedly higher average temperature level in the first flow path 1 than in the second flow path 2. To optimize the heat exchanger capacity, particularly taking into account as low an overall flow resistance as possible, the flow resistances of the first flow path 1 and of the second flow path 2 are configured differently:

In a first exemplary embodiment according to FIG. 2, each of the flow paths 1, 2 comprises a bundle of in each case nine flow ducts 6, 7, each of which has a rectangular cross section. The external dimensions of the flow ducts 6, 7 are in each case identical here. However, the flow ducts 6 of the first flow path 1 and the flow ducts 7 of the second flow path 2 have turbulence-generating means in the form of embossings 6*a*, 7*a* which have a different size. The embossings 6*a* of the first flow ducts 6 project to a lesser depth into the duct cross section than the embossings 7*a* of the second flow ducts 7. The geometric free flow cross section of the second flow ducts 7 thereby becomes smaller, as compared with the geometric free cross section of the first flow ducts 6. Moreover, more turbulences are introduced into the exhaust gas stream in the second flow ducts 7 than in the first flow ducts 6 due to the fact that the turbulence-generating means 7*a* project inward to a greater depth. The turbulence-generating means 6*a*, 7*a* may be dimples and/or winglets. Alternatively or additionally, they may also be structured inserts known per se which are pushed into the flow ducts 6, 7 and welded.

Figure 3:
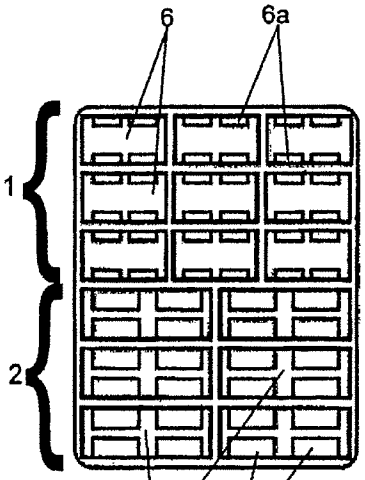
FIG. 3 shows a diagrammatic cross section through a second exemplary embodiment of a heat exchanger according to the invention.

In the second exemplary embodiment according to FIG. 3, the first flow path 1 is set up in the same way as in the first exemplary embodiment. In contrast to the first exemplary embodiment, the second flow path 2 not only has different turbulence-generating means 7*a*, but also has a smaller number of flow ducts 7, as compared with the first flow path 1, which in each case have a different external dimension with respect to the flow ducts 6 of the first flow path 1. Although, in the second exemplary embodiment, the second flow path comprises fewer flow ducts 7, instead with a larger external dimension, the turbulence-generating means 7*a* which are projecting inward to a greater depth generate, overall, a higher flow resistance for the second flow path 2 than for the first flow path 1. Owing to the changed number and external geometry of the flow ducts 7, in the second exemplary embodiment the flow resistance of the second flow path is somewhat lower than the flow resistance of the second flow path in the first exemplary embodiment.

Figure 4:
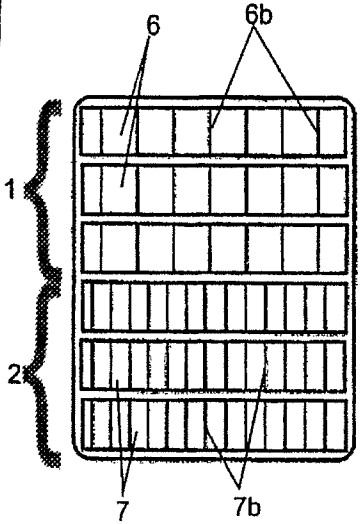
FIG. 4 shows a diagrammatic cross section through a third exemplary embodiment of a heat exchanger according to the invention.

In the third exemplary embodiment according to FIG. 4, each of the flow paths 1, 2 has in each case three parallel flat tubes 6, 7 as flow ducts which have in each case identical external dimensions. The flow ducts 6, 7 are provided with rib-like inserts 6*b*, 7*b*, with the result that the contact surface between the exhaust gas stream and the heat-conducting metal is enlarged. To provide different flow resistances of the first and the second flow paths 1, 2, fewer ribs are provided in the case of the flow ducts 6 of the first flow path 1 than in the case of the flow ducts 7 of the second flow path 2. On account of the higher rib density of the second flow path 2, with the dimensions and numbers of the flow ducts 6, 7 otherwise being the same, the second flow path 2 has a higher flow resistance than the first flow path 1. The third exemplary embodiment illustrates that, even in the case of predominantly laminar flows, different flow resistances can be generated by means of an appropriate design of the flow ducts 6, 7.

The various approaches for achieving different flow resistances according to the exemplary embodiments described may be combined with one another in any desired way. In this case, account must be taken of the fact that, in the case of exhaust gas heat exchangers, not only is the resulting flow resistance an important criterion, but also other parameters, such as the tendency to the condensation of deposits which counteract a constant action of the heat exchanger throughout its useful life. Such deposits are formed mainly in the cooler part of the exhaust gas stream. In an individual case, therefore, it may also be advantageous that the flow resistance of the second flow path is higher than the flow resistance of the first flow path, the condensation of deposits being reduced by means of highly turbulent fractions.

The fluid to be cooled is, in particular, exhaust gas. In another version, the fluid to be cooled is charge air, oil, in particular transmission oil, an aqueous cooling liquid, refrigerant of an air conditioning system, such as CO2.

In the exemplary embodiment illustrated, the heat exchanger is at least an exhaust gas cooler. In another exemplary embodiment, the heat exchanger is at least a charge air cooler and/or an oil cooler and/or a coolant cooler and/or a condenser of an air conditioning system and/or an evaporator of an air conditioning system and/or a gas cooler of an air conditioning system. In another exemplary embodiment, the heat exchanger is a combination of at least one exhaust gas cooler and of at least one other of the heat exchangers mentioned above.

In another version, the heat exchanger has a flow resistance of the flow path 1 which lies between 0.1% and 300%, in particular between 1% and 100%, in particular between 5% and 80%, between 10% and 70%, between 20% and 60%, between 30% and 50% above the flow resistance of the flow path 2, preferably only 10% above the flow resistance of the flow path 2.

In another embodiment, the flow resistance of the first flow path 1 lies below the flow resistance of the flow path 2.

Heat exchangers with a deflection region 13 are designated as U-flow heat exchangers, since the fluid to be cooled flows in a first flow path as far as a deflection portion and, after deflection in a second flow path, flows back essentially in the opposite direction to the flow direction in the first flow path. In another version, the heat exchanger is designed as an I-flow heat exchanger, that is to say the inflow side and outflow side of the fluid to be cooled lie on different sides of the heat exchanger which mostly lie opposite one another. The heat exchanger is therefore designed in such a way that at least part of the cooling fluid flows through the at least one first flow path and/or at least part of the fluid to be cooled flows through the at least one second flow path. The at least one first and the at least one second flow path run essentially parallel to one another.

The at least one first flow path has a different flow resistance from the at least one second flow path, the flow resistance of the at least one first flow path being higher than or lower than or equal to the flow resistance of the second flow path.

The examples described above outline in each case forms of construction of tube bundle heat exchangers. The invention is not restricted to these, but extends also to disk types of construction and other types of construction in which the exhaust gas stream runs successively through various flow paths.

The invention claimed is:

1. A heat exchanger for a motor vehicle, comprising a first flow path defined by a first array of separate parallel flow ducts having a rectangular cross section, the plurality of flow ducts in the first array being arranged in a plurality of rows and a plurality of columns, a first set of turbulence-generating members provided in the first flow path, a deflection region following the first flow path, a second flow path following the deflection region defined by a second array of separate parallel flow ducts having a rectangular cross section, the plurality of flow ducts in the second array being arranged in a plurality of rows and a plurality of columns, and a second set of turbulence-generating members provided in the second flow path, wherein each flow duct in the first array of flow ducts has a same flow resistance and each flow duct in the second array of flow ducts has a same flow resistance, and wherein a first depth into which the first set of turbulence-generating members project into the first flow path is less than a second depth into which the second set of turbulence-generating members project into the second flow path such that a flow resistance of the first flow path is lower than a flow resistance of the second flow path.

2. The heat exchanger according to claim 1, further comprising a fluid to be cooled being capable of flowing through the first and second flow paths, and a coolant being capable of flowing around the first and second flow paths for discharge of heat.

3. The heat exchanger according to claim 2, wherein the fluid is an exhaust gas from an internal combustion engine of the motor vehicle.

4. The heat exchanger according to claim 1, wherein the first and second set of turbulence-generating members are designed as shaped-out portions, projecting into the first and second flow paths, of walls of the first and second flow paths.

5. The heat exchanger according to claim 1, wherein the first and second set of turbulence-generating members are designed as inserts secured in the first and second flow paths.

6. The heat exchanger according to claim 1, wherein each flow duct in the first array of flow ducts of the first flow path has a larger cross-sectional area than each flow duct in the second array of flow ducts of the second flow path.

7. The heat exchanger according to claim 1, wherein the first flow path has a free cross-sectional area which is larger than that of the second flow path.

8. The heat exchanger according to claim 2, wherein the first and second flow paths are arranged in a housing through which the coolant flows.

9. The heat exchanger according to claim 8, wherein the coolant is a liquid.

10. The heat exchanger according to claim 2, further comprising a connection region with a first connection for supplying the fluid to the first flow path and with a second connection for discharging the fluid from the second flow path.

11. The heat exchanger according to claim 10, wherein the connection region comprises an actuating element configured to selectively set a direct link between the first connection and the second connection in order to bypass the first and second flow paths.

12. The heat exchanger according to claim 1, wherein the first and second arrays of flow ducts are produced from aluminum, high-grade steel or a combination thereof.

13. The heat exchanger according to claim 9, wherein the coolant is a cooling liquid of a main cooling circuit of the motor vehicle.

14. The heat exchanger according to claim 2, wherein the fluid flows through the first flow path in a longitudinal direction, is deflected in the deflection region following the first flow path, and flows through the second flow path in a direction opposite to the longitudinal direction through the first flow path.

* * * * *